United States Patent [19]

Swartz et al.

[11] Patent Number: 4,972,611

[45] Date of Patent: Nov. 27, 1990

[54] SHOE CONSTRUCTION WITH RESILIENT, ABSORPTION AND VISUAL COMPONENTS BASED ON SPHERICAL POCKET INCLUSIONS

[75] Inventors: Henry D. Swartz, Chestnut Hill; Martin P. Birrittella, Newton, both of Mass.

[73] Assignee: Ryka, Inc., Weymouth, Mass.

[21] Appl. No.: 232,617

[22] Filed: Aug. 15, 1988

[51] Int. Cl.[5] ..... A43B 5/06; A43B 13/18

[52] U.S. Cl. ..... 36/28; 36/114

[58] Field of Search ..... 36/28, 29, 43, 44, 71, 36/136, 137; 428/313.3; 350/98

[56] References Cited

U.S. PATENT DOCUMENTS

| | | | |
|---|---|---|---|
| 3,791,050 | 2/1974 | Egtvedt | 36/28 |
| 3,885,246 | 5/1975 | Tung | 350/98 X |
| 4,250,136 | 2/1981 | Rex | 428/313.3 |
| 4,252,910 | 2/1981 | Schaefer | 36/71 X |
| 4,712,319 | 12/1987 | Goria | 36/137 |

FOREIGN PATENT DOCUMENTS

| | | | |
|---|---|---|---|
| 3114944 | 10/1982 | Fed. Rep. of Germany | 36/44 |
| 3723549 | 2/1988 | Fed. Rep. of Germany | 36/43 |
| 233748 | 10/1924 | United Kingdom | 36/28 |
| 2203025 | 10/1988 | United Kingdom | 36/28 |

*Primary Examiner*—Paul T. Sewell
*Assistant Examiner*—Andrew D. Meyers
*Attorney, Agent, or Firm*—Jerry Cohen

[57] ABSTRACT

An athletic shoe with rebound characteristics thereof formed by a first class of hollow core spheres (32, 34, 36) of high resilience mounted in pockets (30A, 30B, 30C) of selected sole regions and a second class of hollow core spheres (38) mounted in exposed heel end pockets for visibility and affording a non-resilient absorption shoe as a whole being very lightweight with the inclusion of such hollow spheres and readily manufacturable therewith.

10 Claims, 3 Drawing Sheets

SHOE CONSTRUCTION WITH RESILIENT, ABSORPTION AND VISUAL COMPONENTS BASED ON SPHERICAL POCKET INCLUSIONS

BACKGROUND OF THE INVENTION

The present invention relates to shoe constructions.

It is a principal object of the present invention to provide construction of shoes and shoe components and materials and manufacturing method therefor which provide high resilience and shock absorption without sacrificing durability.

It is a further object of the invention to accomplish the foregoing object with economy of manufacture.

It is a further object of the invention to provide visual uses of the construction for safety and aesthetic purposes.

SUMMARY OF THE INVENTION

The foregoing and other objects are attained in accordance with the present invention through the provision of flexible large plastic containers of spherical or near spherical form; these are contained in pockets within a mid-sole. The large diameter spherical or near spherical containers ("spheres") typically are 1/16" to ½" in diameter, are preferably, but not necessarily, hollow within continuous thick walls which are made of tough elastomeric material such as rubber products, or any suitable thermoplastic materials.

There are two principal classes of such spheres and related accommodating shoe sole supports therefor and subclasses within each such class.

The first such class is an arrangement of such spheres in groups at selected areas of a sole especially heel-aligned, ball (of the foot) aligned and and other impact or pressure regions of a mid-sole. These spheres are (preferably) hollow spheres of stiff, but resilient and thick-walled natural or synthetic materials, preferable composite materials with such rubbery materials as matrix and inclusions of fine particles, light weight reinforcements, preferably microspheres. The effect of such construction is to afford a high spring characteristic to the shoe superior to such characteristics as obtained by state of the art lateral tubes running through a mid-sole or flat pouch airbags over large areas of a shoe sole.

The second class of spheres comprises spheres in pockets at the heel region of a sole which are visible from the outside and, preferably, partly project from the heel region. These spheres have a deadening shock absorbing effect on impact rather than the resilience of the first class of spheres and related housings. Spheres of the second class may be filled in their walls with chips of intrinsic color or chips responsive to external stimuli, such as fluorescent materials.

The reinforcements usable in the wheels of the spheres of the first class are, preferably the micro/-macro ballons described in our copending U.S. application, SHOE SOLE COMPOSITE MATERIAL, applicants Henry D. Swartz, Martin P. Birrittella, Ser. No. 232,619, filed Aug. 15, 1988 (of even date herewith), the disclosure of which is incorporated herein by reference as though set out at length herein—and in its entirety.

The spheres of the first class can be directly inserted into special mid-sole pockets (which run all the way or partially through the mid-sole thickness), or embedded therein by casting or injection molding the mid-sole around them. Some mid-sole materials are usually not so castable, e.g., EVA. But the spheres can be set in cast or molded suitable plastics, e.g., polyurethane or polyurethane/rubber as part-sole blanks which can be set into open spaces of a sole blank of EVA or the like, in one or more of the above mentioned strategic areas to complete the sole.

Other objects, features, and advantages will be apparent from the following detailed description of preferred embodiments taken in conjunction with the accompanying drawing in which.

DETAILED DESCRIPTION OF PREFERRED EMBODIMENTS

Figure 1:
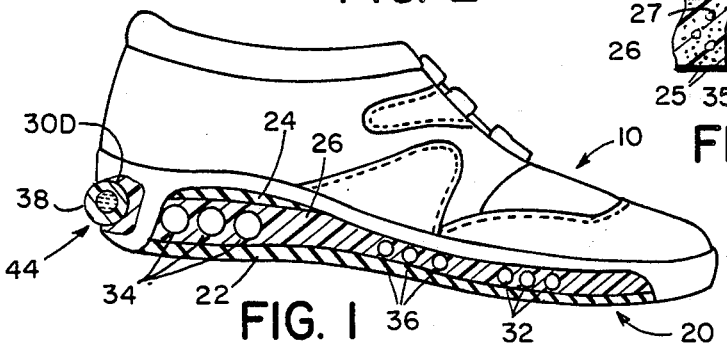
FIG. 1 is a side view of an athletic shoe with partial cutaways revealing, in cross section parts of the sole assembly made in accordance with a preferred embodiment of the invention.

FIG. 1 shows an athletic shoe with an 'upper' 10 and sole assembly 20. The latter comprises an outer sole layer 22, inner sole (and/or sock lining 24 and a mid-sole 26. The latter is made at least primarily of polyurethane or other plastic materials (including elastomerics) of low density; low cost; high resistance to crumbling, shedding or like deterioration under widely varying conditions of ambient and body moisture, heat, pressure, impact and flexing; and of good formable and bonding characteristics. This mid-sole may be of unitary or multiple part construction as described below. The mid-sole has a rear surround lip 28 (FIGS. 1. 2 and 4) rising around the wearer's heel and providing an area for effective attachment to the upper by stitching, adhesive and/or other bonding means.

The mid-sole has groups of pockets 30A, 30B, 30C, 30D, of similar or differing forms (as hereinafter described) and accommodating respectively, spheres 32, 34, 36, 38.

Figure 2:
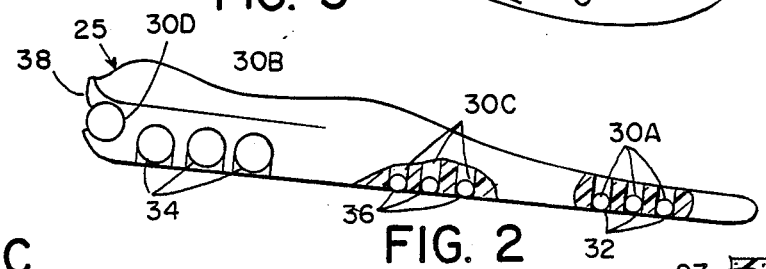
Figure 2C:
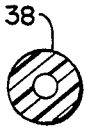
FIGS.2A and 2C are cross-sections of typical members of the above described first and second classes of spheres and FIG. 2B is a cross section of a mid-sole portion containing one of the first class of spheres.
Figure 2A:
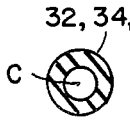
Figure 2B:
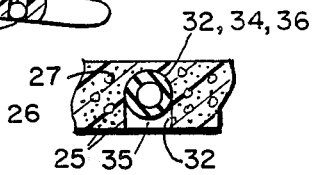

FIGS. 2A–2B show a member of the first class of spheres 32 or 34 or 36 in cross section per se and as incorporated into a pocket (e.g., 32) of a composite material 26 and FIG. 2C shows a member 38 of the second class.

The size of spheres 32/34/36 varies from 1/16 to ½ inch diameter and with a wall thickness of about ¼ to about ¾ of radius preferably at the high end of such range to leave a tiny core C, if any. The wall is made of a high strength plastic or natural or synthetic rubber and is preferably filled with glass or ceramic microballons or other reinforcement to a volume percent of 5–50% thereof to provide a low density and low weight and yet enhance rather than degrade stiffness and toughness of the thick wall.

The spheres 38 of the second class are, preferably, made of transparent PVC or the like (e.g., acrylics) in diameters of 0.05–0.5 inches preferably 0.10–0.20 inches. The spheres can be intrinsically colored (i.e., dyed and/or with intrinsically colored color chips suspended therein—and/or extrinsically colorable, i.e., containing agents that will emit color in response to external stimuli of ambient light, heat and/or pressure. The color may be international fluorescent red/orange or other bright safety color and/or a color or colors selected on the basis of decorative considerations.

Figure 3:
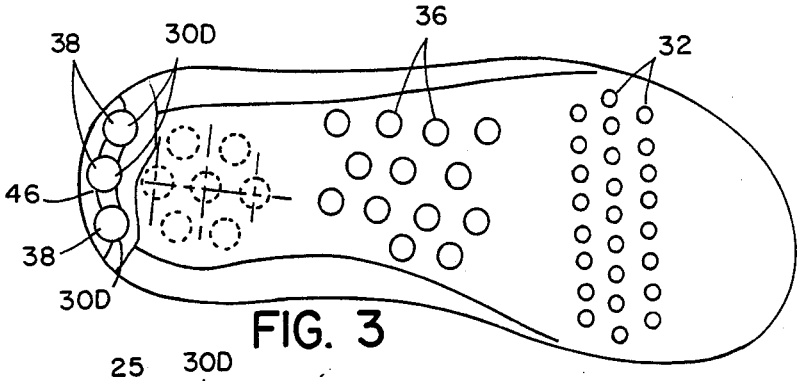
FIG. 2 is a side view and FIG. 3 is a top view, both partially sectioned of a mid-sole of the FIG. 1 embodiment.
Figure 4:
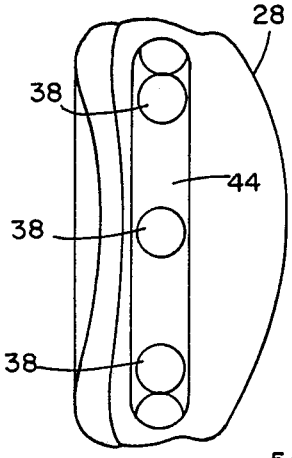
FIG. 4 is a rear view of the heel of the FIG. 1 embodiment of the shoe.
Figure 5:
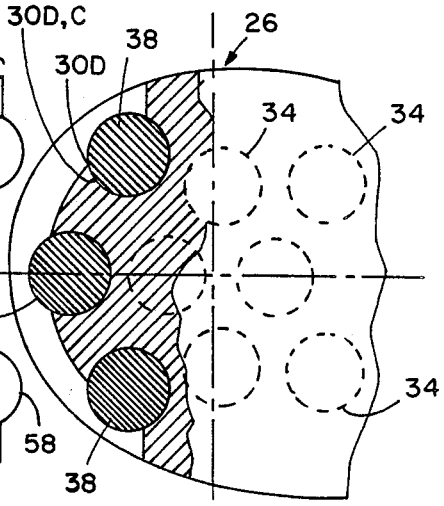
FIG. 5 is a top view, partially sectioned of the mid-sole component.

The spheres 38 are in a recessed elongated window 44 (FIGS. 3, 4, 5) at the heel edge and housed securely in pockets 30D which have at least a hemispheric grip on their respective spheres and slightly more than hemispheric grip in collar sections 30D/C.

Spheres of both classes are usually pre-molded or cast, but can be made by other means. The pockets 30A, 30B, 30C, 30D can be made by die cutting and/or by casting; in using inserts of or casting equipment. The term "spheres" as used herein refers to approximate (aspect ratio of 0.5—2.0 in all cross-sections) as well as essentially perfect spheres.

Figure 6:
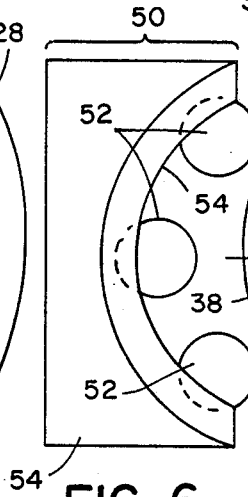
FIG. 6 is a related top view of a portion of a manufacturing, mold insert (which helps reveal the finished heel component) for the FIG. 4–5 heel.

FIG. 6 shows a discrete mold insert piece 50 (or part of a unitary mold frame) with steel balls 52 and an edge piece 54 mounted thereon to form pockets 30D (for spheres 38 and the window 44 in the course of molding. This apparatus affords a construction of pockets 30D and window 44 with clean edges and a smooth appearance overall, and strong gripping collar sections.

After the mid-sole 26 is extracted from the mold the spheres 38 can be press fit therein. The flexible color sections 30D/C accommodate withdrawal of balls 52 and insertion of spheres 38.

Figure 7B:
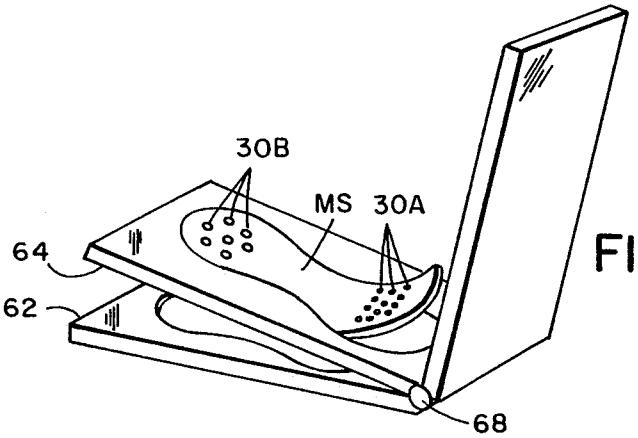
FIGS. 7, 7A, 7B, 7C are isometric views of a sole mold assembly in various stages of operation.
Figure 7C:
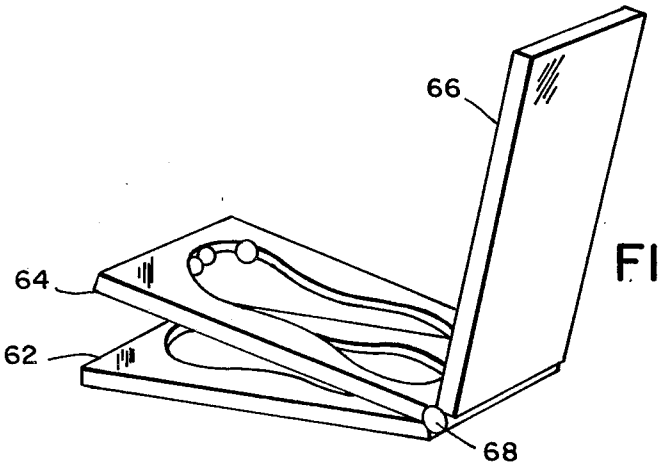
Figure 7:
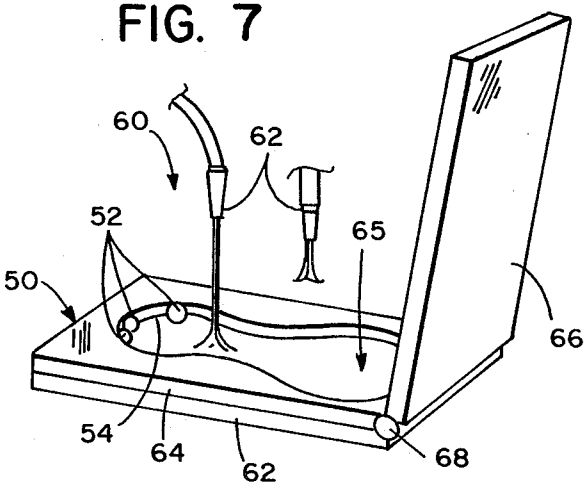
Figure 7A:
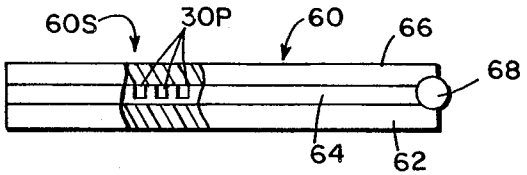

FIG. 7 shows a mold 60 for a sole with one or more nozzles 62 for pouring resin (or resin precusors), fluent materials with or without microsphere reinforcements suspended in such feeds(s). The mold comprises a bottom plate 62, a middle frame 64 (with a sole form opening 65) and a "top" plate 66 (actually confronting, when closed the bottom of the eventual sole), all mounted to a common hinge 68. The section 50 with balls 52 and detent 54 are integral to mid-frame 64. FIG. 7B shows the mold assembly in closed position. As indicated at the sectioned portion 60S, these prongs 30P on plate 66 for reserving space to form pockets 30B (see FIG. 2) of the finished product; and similar prongs (not shown) can provide for pockets 30A, 30C, if used, and balls 52 form pockets 30D. The resin foams up and cures in situ in the essentially closed cavity formed within the closed mold assembly (by exothermic heat and/or by external heating depending on the resin system involved) except in the spaces reserved. The spherical reinforcements inJected with the resin are dispersed in uniform, selectively graded or selectively clustered form, as disclosed in our above cited copending application, in one or more such feed and cure cycles. The heating occurs over a two to five minute period and the closed mold can then be poured through a tunnel heater at low heat (100–300° F.) to retard cooling and extend the last stages of cure. The isometric view of FIG. 7B shows the opening of the mold to reveal the formed mid-sole MS with pockets 30A, 30B showing pockets 30C are omitted in this embodiment and pockets 30D are hidden from view. FIG. 7C shows the assembly with the sole removed by simply pulling off the balls 52. The collars 30D/C (FIG. 5) yield and spring back easily around the steel balls and are formed without any flashing or like mars. The balls 52 remain fixed and ready for the next cycle (balls placed loosely in the mold cavity are generally displaced by the foaming process).

Release agents are applied permanently (or repeatedly between mold cycles) to all resin exposed surfaces thereof.

Figure 8:
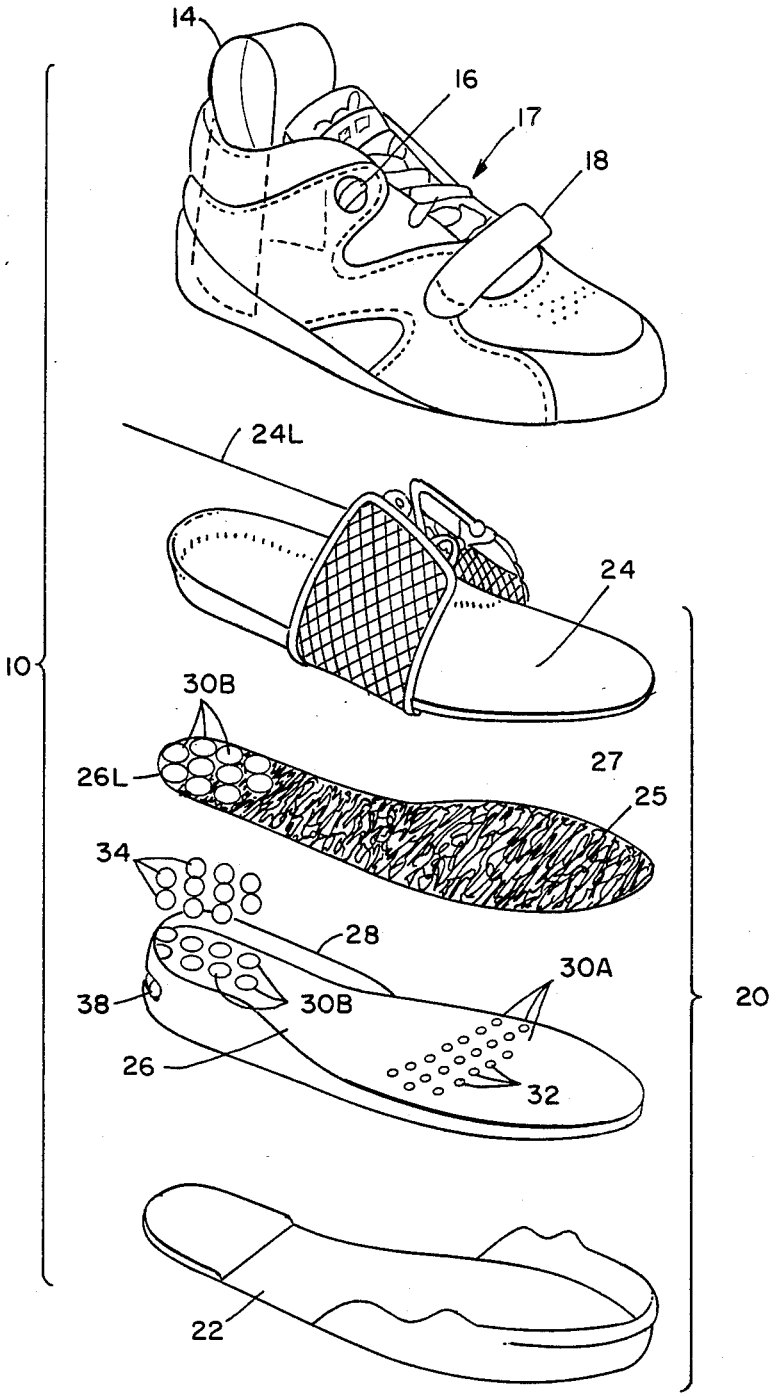
FIG. 8 is an exploded view of an athletic shoe incorporating the molded mid-sole.

FIG. 8 is an exploded view of the shoe 10 showing its upper 12, a removable support 14, a domed lacing system 16 and buckle 18 and its sole assembly 20 comprising an outsole 22, a sock liner 24 with a mesh lock system and mid-sole 26 shown in a hypothetical form with a top skin layer 26 exploded up and indicated holes 30B and a high fill of reinforcements 25, 27 (see FIG. 2A) and the balance of the mid-sole showing revealing spheres 34 and 32 and pockets 30A, 30B.

It will now be apparent to those skilled in the art that other embodiments, improvements, details, and uses can be made consistent with the letter and spirit of the foregoing disclosure and within the scope of this patent, which is limited only by the following claims, construed in accordance with the patent law, including the doctrine of equivalents.

What is claimed is:

1. An athletic shoe construction comprising means defining a shoe upper, means defining a sole element, secured to the upper, the latter comprising a lightweight elastomeric material with spheres embedded snuggly in spherical conforming pockets at one or more side edge regions of the sole element in window and having sphere portions uncovered by the sole element to be visible from outside, and wherein the spheres protrude from the shoe and are entrapped by resilient collars integral to the sole element, and wherein the spheres are constructed and arranged as a whole to have a deadening effect impact absorption characteristic limited to the sole side edge region of their location.

2. A shoe construction as in claim 1 wherein the sole element has resilient spheres encapsulated therein.

3. A shoe construction as in claim 2 wherein the resilient spheres are thick walled, rubbery materials and an energy return of such spheres substantially greater than the surrounding sole material.

4. A shoe construction as in claim 3 wherein the thick walled, resilient spheres contain dispersed reinforcing materials.

5. A shoe construction as in claim 4 wherein the reinforcing materials are hollow particles.

6. A shoe construction as in claim 2 wherein the resilient spheres are accommodated in pre-formed pockets of a sole.

7. A shoe construction as in claim 2 wherein the resilient spheres are included in a cast (or molded) section.

8. A shoe construction as in claim 1 wherein the spheres are located at the sole edge region of the shoe at the heel thereof.

9. A shoe construction as in claim 1 wherein the spheres are colored by externally stimulated coloring means.

10. A shoe construction as in claim 1 wherein a window recess is provided around the projecting spheres.

* * * * *